United States Patent [19]

Yamada

[11] Patent Number: 4,635,977

[45] Date of Patent: Jan. 13, 1987

[54] DOOR HANDLE DEVICE UNLOCKABLE FROM INDOOR SIDE

[75] Inventor: Kenichi Yamada, Yokohama, Japan

[73] Assignee: Takigen Manufacturing Co., Ltd., Tokyo, Japan

[21] Appl. No.: 683,350

[22] Filed: Dec. 19, 1984

[30] Foreign Application Priority Data

Jun. 14, 1984 [JP] Japan ..... 59-088706[U]

[51] Int. Cl.[4] ..... E05C 15/02; E05C 5/02

[52] U.S. Cl. ..... 292/92; 292/66; 292/166; 292/206; 292/DIG. 71

[58] Field of Search ..... 292/166, 341.17, 92, 292/21, 149, 206, 105, DIG. 65, DIG. 71, 65–67

[56] References Cited

U.S. PATENT DOCUMENTS

| | | | |
|---|---|---|---|
| 2,415,587 | 2/1947 | Groeger | 292/DIG. 65 X |
| 2,533,396 | 12/1950 | Payne | 292/DIG. 65 X |
| 2,636,767 | 4/1953 | Groeger | 292/DIG. 65 X |
| 3,494,650 | 2/1970 | Slopa | 292/92 |
| 3,871,694 | 3/1975 | White | 292/92 |
| 3,936,086 | 2/1976 | Berkowitz | 292/DIG. 65 X |
| 4,203,622 | 5/1980 | Cook et al. | 292/DIG. 65 X |
| 4,547,008 | 10/1985 | Takasaki | 292/341.15 |

*Primary Examiner*—Robert L. Wolfe
*Assistant Examiner*—Russell W. Illich
*Attorney, Agent, or Firm*—Martin Smolowitz

[57] ABSTRACT

A door handle device unlockable from indoor side of refrigerators, which device enables a person trapped in a refrigerator by accident to escape therefrom speedily by a simple operation. This handle device comprises a handle unit fastened to a door, and a latch receiver unit fastened to a wall of a refrigerator. The handle unit consists of the fixed seat attached to the door, a movable body connected to the fixed seat by a pivot, a latch member, and an operating handle for driving the latch member. The door handle device also has a setting bolt, an operating portion is positioned in the inside of the refrigerator. The setting bolt is inserted into a threaded bore provided in a rear portion of the movable body to fix the movable body to the door. The trapped person has only to turn the operating portion of the setting bolt to take out the bolt from the threaded bore and thereby permit the movable body to pivot and release the latch member from the latch receiver unit and then open the door.

6 Claims, 5 Drawing Figures

DOOR HANDLE DEVICE UNLOCKABLE FROM INDOOR SIDE

BACKGROUND OF THE INVENTION

1. Field of the Invention

This invention relates to a door handle device for a walk-in type refrigerator and freezer, and more particularly to a door handle device which can be unlocked from indoor side by a person working in the refrigerator, who is trapped therein owing to an erroneous door closing operation of another person from outdoor side or to any accident. The person can escape from the refrigerator by himself with a manual operation of the door handle device.

2. Description of the Prior Art

The present inventor proposed a door handle device previously in Japanese Utility Model Application No. 40978/1972, which includes a latch receiver unit divided into a fixed seat secured to a wall of a refrigerator, and a latch receiver body connected pivotably to the fixed seat. The latch receiver body is designed so that, when a push rod is operated from the inside of the refrigerator to turn the latch receiver body, a latch member of a handle unit attached to a refrigerator door and a latch receiving member of the latch receiver body can disengage from each other.

However, in this door handle device, the fixed seat and the latch receiver body are connected by a belt-like connector which is liable to be bent when a greater stress is imparted thereto. Therefore, the extent to which the solidity of the structure constituting the handle device can be increased is limited to a certain level.

In order to re-assemble the fixed seat and the latch receiver body after the trapped person escapes by himself, it is necessary that these parts be put in order as the connector and an interlocking means joined thereto are retained in the predetermined positions. This causes the re-assembling operation to become complicated.

SUMMARY OF THE INVENTION

An object of the present invention is to provide a handle device having an internal unlocking mechanism on the side of a handle unit therein, for solving the above-mentioned problesm.

According to the invention, the door handle device unlockable from an indoor side of a door, such as for a refrigerator compartment, comprises a handle unit fastened to the door and a latch receiver unit fastened to a wall of the compartment. The handle unit consists of a fixed seat attached to the door, and a movable body connected to the fixed seat by a pivot. The movable body is provided with a slidable latch member adapted to engage with and disengage from a latch receiving member of the latch receiving unit, and with an operating handle adapted to drive the latch member. A setting bolt is inserted intoa through bore provided in the door and is engaged with a threaded bore provided in a rear portion of the movable body, so as to secure the movable body to the door. An operating portion of the setting bolt positioned inside the refrigerator body is adapted to be turned relative to the movable body, so as to remove the setting bolt from the threaded bore and permit turning the movable body about the pivot and thereby disengaging the latch member from the latch receiving member to permit opening the door.

The above and other objects as well as advantageous features of the invention will become apparent from the following description of the preferred embodiment taken in conjunction with the accompanying drawings.

DESCRIPTION OF THE PREFERRED EMBODIMENT

Figure 1:
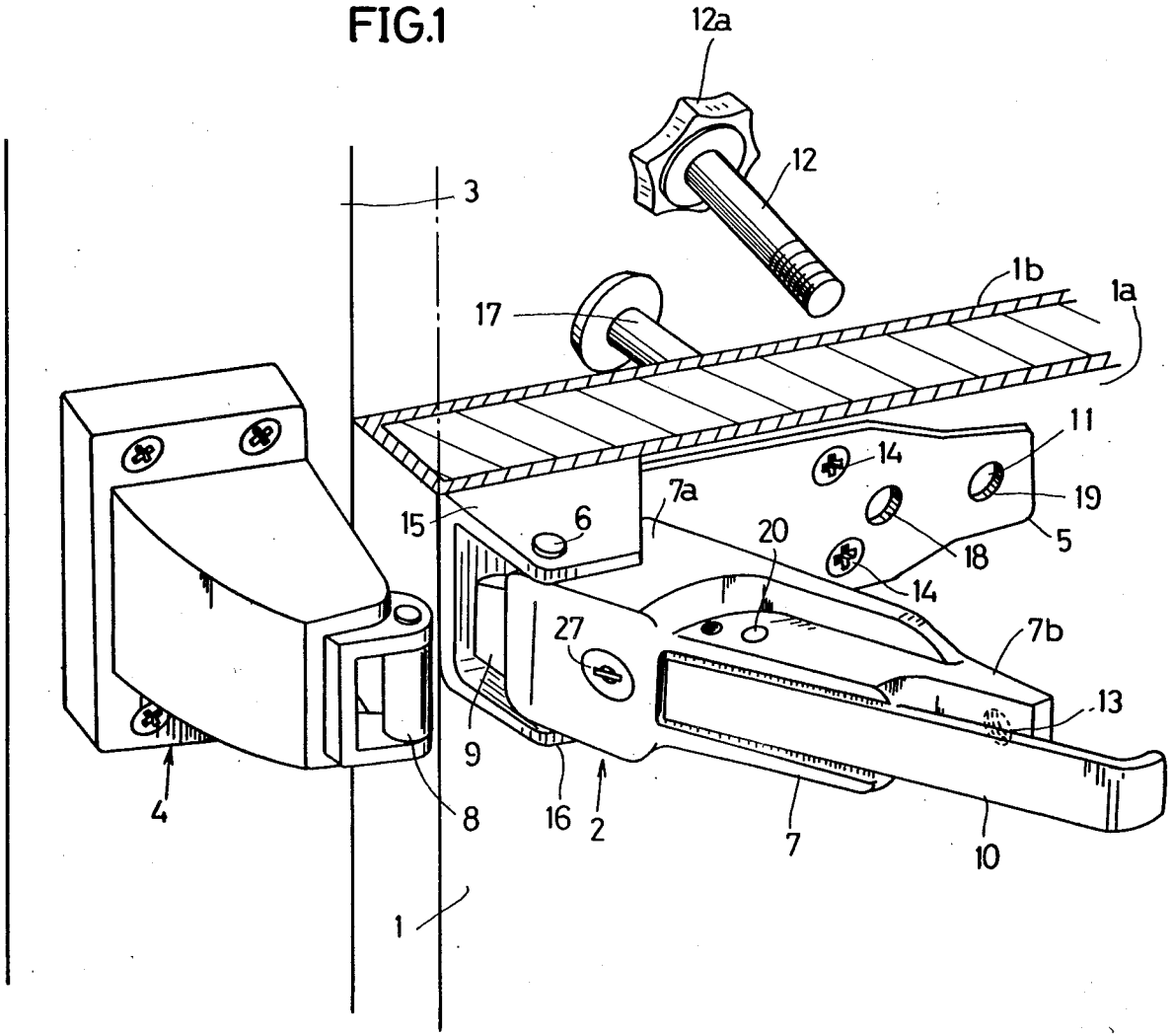
FIG. 1 is a partially cutaway perspective view of a door handle device according to an embodiment of the present invention which is in a door-unlocked state.
Figure 2:
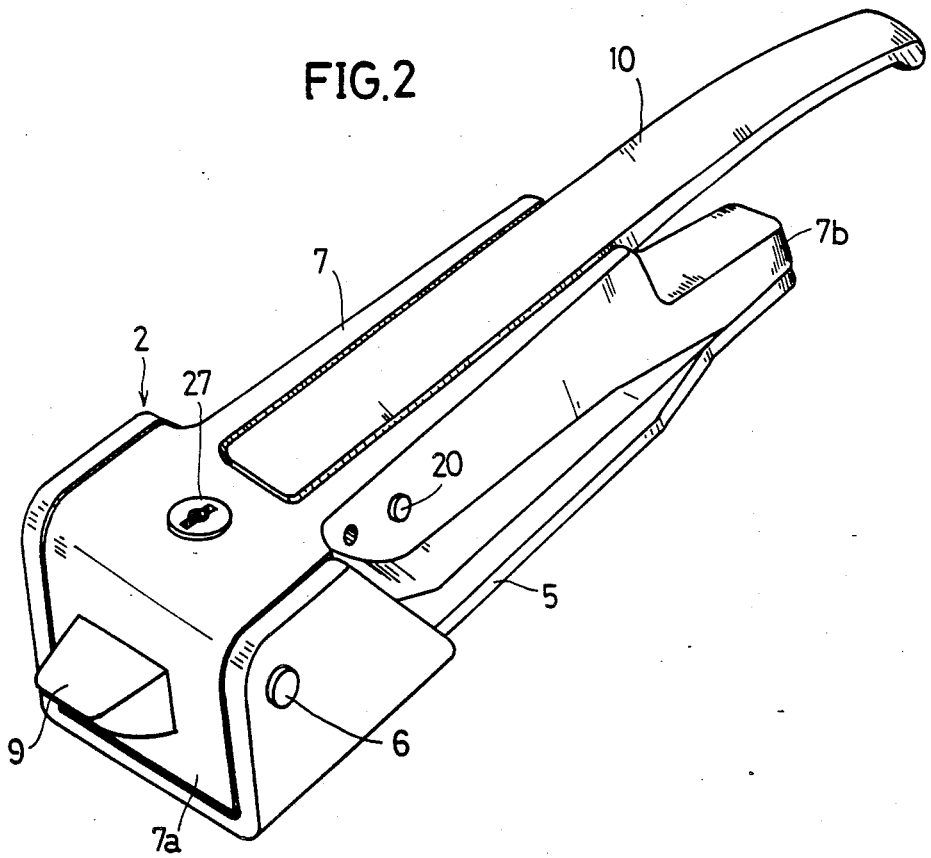
FIG. 2 is a perspective view of a handle unit only of the handle device as shown in FIG. 1.
Figure 3:
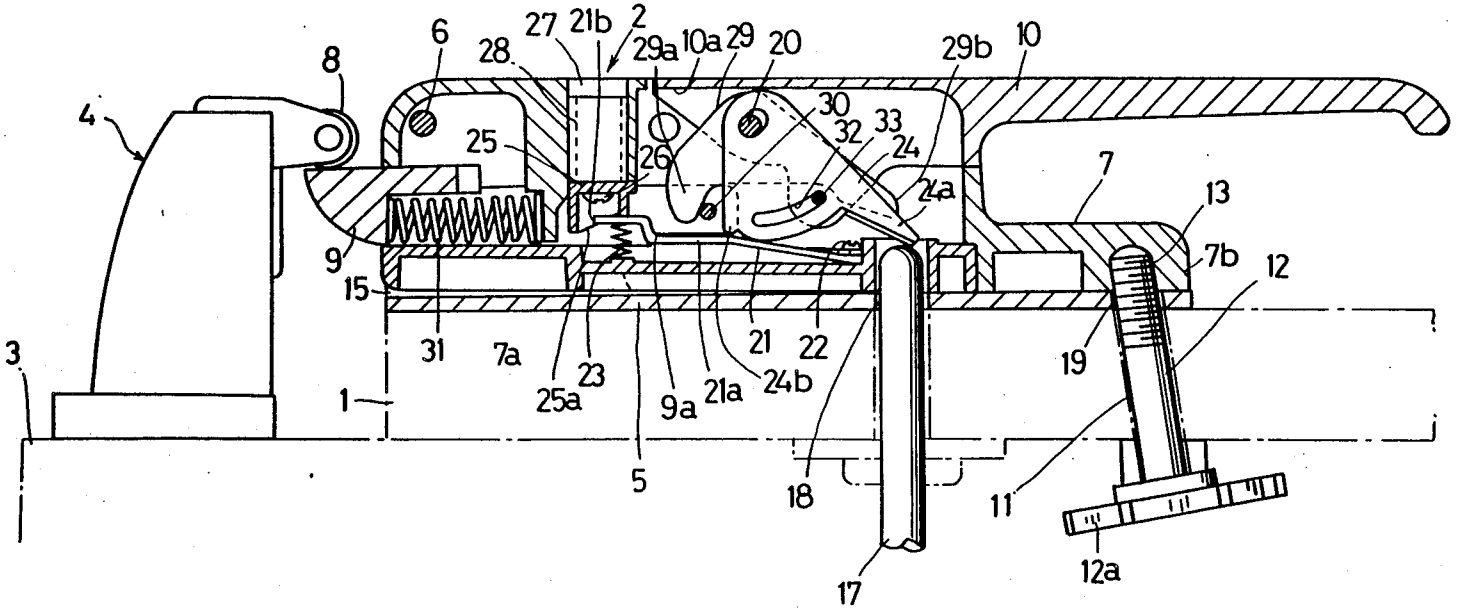
FIG. 3 is a horizontally sectional view of the handle device of FIG. 1, which is in a door-locked state.

The present invention will be now described by using the reference numerals in the accompanying drawings. The door handle device unlockable from indoor side comprises a handle unit 2 fixed to a door 1, and a latch receiver unit 4 fixed to a wall of a refrigerator body or compartment 3. The handle unit 2 consists of a fixed seat 5 attached to the door 1, and a movable body 7 connected to the fixed seat 5 by a pivot 6. The movable body 7 is provided with a latch member 9 adapted to engage with and disengage from a latch-receiving member 8 of the latch receiver unit 4, and an operating handle 10 for driving the latch member 9. A setting bolt 12 having a operating portion 12*a*, which is positioned on the inner side of the refrigerator 3, is inserted into a through bore 11 provided in the door 1, and it is then fitted into a threaded bore 13 provided in a rear portion of the movable body 7, to thereby fasten the movable body 7 to the door 1.

When the door of refrigerator, which is provided with the door handle device, is closed and locked by an erroneous door opreration of another person or by accident, a person trapped in refrigerator 3 may turn the above operating end portion 12*a* of the setting bolt 12 so as to take out the bolt 12 from the threaded bore 13 in the movable body 7 of the handle unit 2. The threaded bore is a blind bore, and it is not open to a front surface of the movable body 7, so that the setting bolt 12 cannot be operated from the outside of the refrigerator 3.

After the moveable body 7 is thus disengaged from the door 1, the person trapped in the refrigerator pushes the door 1 outward, so that the latch member 9 of the movable body 9 is pressed by the latch-receiving member 8 of the latch receiver unit 4. Consequently, the movable body 7 is turned around the pivot 6. During this pivoting movement of the body 7, the latch member 9 disengages from the latch-receiving member 8.

The door 1 locked against the wall 3 of the refrigerator can thus be unlocked reliably from the inside thereof, without pulling the operating handle 10 of the handle unit 2 from the outside of the refrigerator to move the latch member 9 backward.

In the embodiment shown in the drawings, the fixed seat 5 fastened to a front portion of the door 1 by a plurality of screws 14 is provided at the front end portion thereof which is on the side of the latch receiver unit 4, with a pair of bearing members 15, 16. A base end portion 7*a* of the movable body 7 is held between the bearing members 15 and 16. The above pivot 6 is inserted through the above bearing members 15, 16 and the base end portion 7*a* of the movable body 7. Since the pivot 6 extends in parallel with a front surface 1*a* of the door 1, the movable body 7 is turned to a position in which the movable body 7 extends at right angles to the front surface 1*a*. The rear surface of the movable body 7 is formed to a shape which is in conformity with that of the fixed seat 5. The movable body 7 in the normal fixed state is in contact with the front surface of the fixed seat 5. The fixed seat 5 is provided at the end portion thereof, which is on the opposite side of the latch receiver unit 4, with a through bore 18 for an internal push rod 17 and a through bore 19 for the setting bolt 12.

The operating handle 10 is connected pivotably to the movable body 7 via a pivot 20 which extends in parallel with the pivot 6. A lock plate 21 is fixed at its rear end portion to the movable body 7 by a screw 22. A side projection 21*a* provided at the front end portion of the lock plate 21 is urged upward by a coiled compression spring 23, and engaged with a vertical surface 9*a* of the latch member 9 so as to prevent the latch member 9 from being moved slidingly in the backward direction.

When a rotor 28 is turned at 180° by a key inserted into a lock 27, a lock cam 25 fixed to the rotor 28 of the lock 27 presses at its lower inclined surface 25*a* a front tongue 21*b* of the lock plate 21 in the downward direction to disengage the side projection 21*a* and the vertical surface 9*a* of the latch member 9 from each other.

When the operating handle 10 is then turned from the outside of the refrigerator 3, an operating lever 29 is pressed by a front driving portion 10*a* of the handle 10, so that a driven shaft 30 provided at a rear end portion of the latch member 9 is drawn by a front end portion 29*a* of the operating lever 29. In accordance with this shaft-drawing operation, the latch member 9 is moved slidingly in the backward direction against the resilient force of a spring 31.

While the handle 10 is turned, a reset lever 24 is drawn by an interlocking shaft 33 engaged with an arcuate slot 32 made therein, to be turned about the pivot 20 accordingly. Since the latch member 9 disengages from the latch-receiving member 8 while the former is moved back slidingly, the door 1 is unlocked, i.e., it becomes openable.

When a rear surface of a driven member 24*a* of the reset lever 24 is pressed by the internal push rod 17 to turn the reset lever 24, a front lower portion 24*b* thereof urges the lock plate 21 downward at an initial stage of the pivotal movement of the lever 24 to disengage the lock plate 21 and the latch member 9 from each other. When the push rod 17 is further moved forward, the operating lever 29, a rear end portion 29*b* of which is in contact with a front portion of the driven member 24*a*, is turned. In accordance with the pivotal movement of this operating lever 29, the latch member 9 is drawn and moved slidingly in the backward direction, so that the door 1 is rendered openable in the same manner as mentioned above.

In this door handle device, the above operating handle 10 dose not take part at all in the operation for moving the latch member 9 slidingly in the backward direction by the internal push rod 17. Accordingly, even when the operating handle 10 is in an immovable condition due to, for example, a hook rod of a padlock inserted therethrough to fix the same, or an obstacle on the front side of the door, the latch member 9 can be slid back reliably to render the door openable. In this embodiment, when either the removing of the setting bolt 12 or the thrusting of the push rod 17 is done, the person trapped in the refrigerator can escape by himself; thus, a double security means is provided.

Since the pivot 6 is inserted through the base end portion 7*a* of the movable body 7 with the threaded bore 13 provided at the free end portion 7*b* thereof, the movable body 7 can be set ready to be turned speedily by merely unscrewing the setting bolt 12 alone which is engaged with the threaded bore 13. This enables the person trapped in a refrigerator to escape therefrom simply and speedily.

The pivotable operating portion 12*a* of the setting bolt 12 is formed in the shape of a large-diameter disc, so that it can produce a strong rotary force even when it is operated manually without using any tools. The operating portion 12*a* is provided with a slip-resistant wavy outer circumferential surface. In the case where the internal push rod 17 and the setting bolt 12 are provided in positions close to each other, one or both of them are preferably extended not at right angles to a rear surface 1*b* of the door 1 but in an inclined manner with respect thereto to secure between these parts a sufficiently wide space for the operations thereof.

A long-armed tool for turning the above-mentioned operating portion 12*a* of the setting bolt 12, such as a hexagonal wrench, may be fitted therearound to move the same with reduced manual operating force. A pivot serving both as the pivot of the movable body 7 and the pivot of the operating handle 10 may be provided. The interlocking means provided between the operating handle 10 and the latch member 9 and the interlocking means provided between the internal push rod 17 and the latch member 9 can also be modified in various manners.

Figure 4:
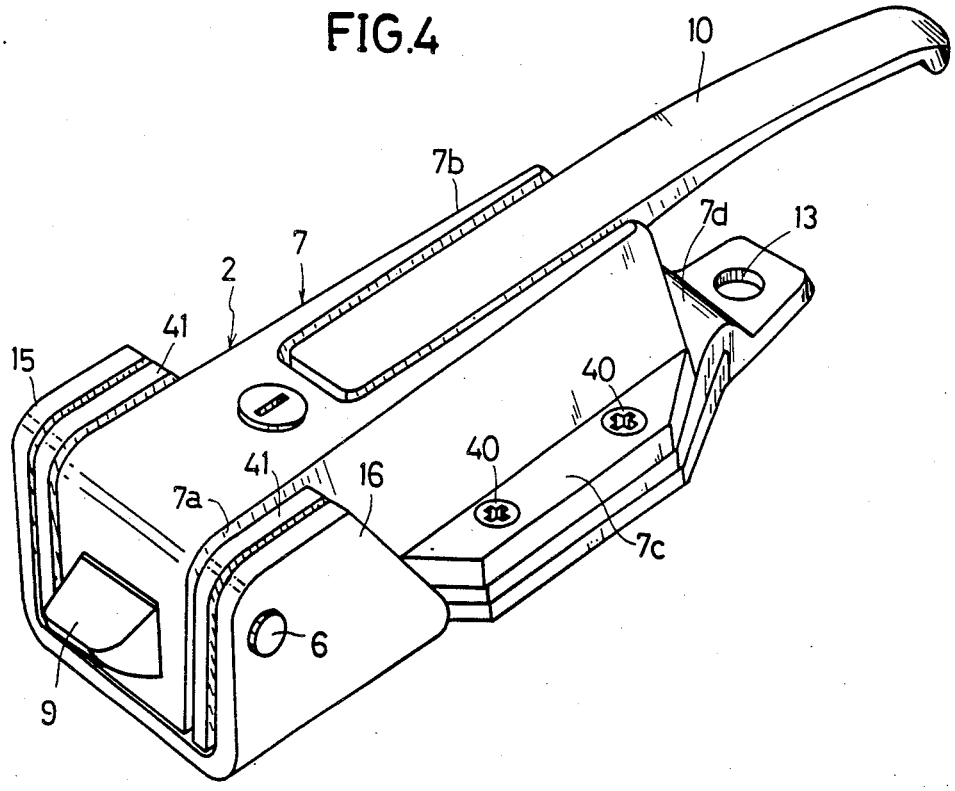
FIG. 4 is a perspective view of a door handle device of another embodiment of the present invention.

In the embodiment as shown in FIG. 4, the movable body 7 is provided with a pair of flanges 7*c* on both sides of the bottom end thereof, and a base plate portion 7*d* is fixed to the flanges 7*c* by set screws 40. Spacers 41 are inserted between the bearing members 15, 16 of the fixed seat 5 and the base end portion 7*a* of the movable body 7. The pivot 6 passes through the spacers 41. The spacers 41 may be omitted, if a gap between the bearing member and the base end portion 7*a* is negligibly narrow.

The fixed seat 5 is shorter than the base plate portion 7*d*, so that the base plate portion 7*d* may cover the end part of the seat 5. The threaded bore 13 is formed at the end part of the base plate portion 7*d*. The present invention may be applied to a ready-made movable body and door handle device by using the above-mentioned base plate portion 7*d*.

Figure 5:
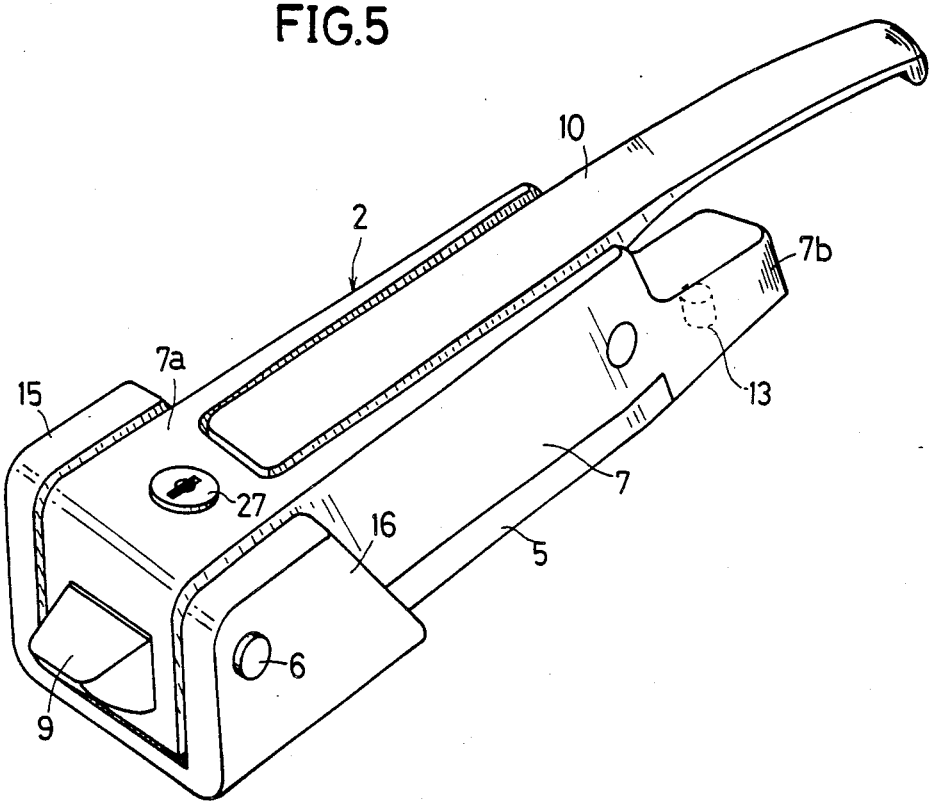
FIG. 5 is a perspective view of a door handle device according to another embodiment of the present invention.

In the embodiment as shown in FIG. 5, although the width of the fixed seat 5 is the same as that of the movable body 7, the length of the fixed seat 5 is shorter than that of the movable body 7, so that the whole of the fixed seat 5 is covered with the movable body 7. The threaded bore 13 is formed on a back surface of the free end portion 7*b* of the movable body 7.

According to the present invention described above, the handle unit 2 comprises the fixed seat 5 fastened to the door 1 and the movable body 7 connected to the fixed seat 5 by the pivot 6, and the movable body 7 is fastened to the door 1 by the setting bolt 12, the operating portion 12*a* of which is disposed on the inner side or indoor side of the refrigerator 3. Therefore, the fixed seat 5 and the movable body 7 are joined together firmly, and the solidity of the structure constituting the door handle can be largely increased in comparison with that of the corresponding structure of the previously described handle device.

In order to fix the movable body 7 of the above handle unit 2 to the door 1 again after the person trapped in a refrigerator escapes therefrom by himself, the movable body 7 is turned reversely about the pivot 6 toward the door 1, and the setting bolt 12 is then screwed to the threaded bore 13. The operation for fixing the movable body 7 to the door 1 again can be done simply.

The present invention is not, of course, limited to the above embodiment; it may be modified in various ways within the scope of the appended claim.

What is claimed is:

1. A door handle device unlockable from an indoor side of a door, the device comprising:

a handle unit (2) fastened to a door, and a latch receiver unit (4) fastened to a wall of a compartment (3), said handle unit (2) consisting of a fixed seat (5) attached to said door, and a movable body (7) connected to said fixed seat by a pivot (6), said movable body being provided with a slidable latch member (9) adapted to engage with and disengage from a latch-receiving member (8) of said latch receiver unit (4);

an operating handle (10) adapted to drive said latch member (9) slidingly in a backward direction against a spring (31); a setting bolt (12) inserted into a through bore (19) provided in said door and engaged with a threaded bore (13) provided in a rear portion of said movable body (7) so as to secure said movable body to said door, said setting bolt having an operating portion (12*a*) positioned inside of said compartment and adapted to be turned relative to the movable body to remove the setting bolt from the threaded bore and permit opening the door.

2. The door handle device as claimed in claim 1, wherein said fixed seat is provided with a pair of bearing members at a front end portion of the fixed seat, and a base end portion of the movable body being held between the bearing members through which said pivot is inserted.

3. The door handle device as claimed in claim 1, wherein said threaded bore provided in a rear portion of said movable body is a blind bore which is not open to a front surface of the movable body.

4. The door handle device according to claim 1, wherein a lock plate is fixed at its rear end portion to said movable body (7) and at its front end engages said latch member (9) to prevent said latch member from being moved slidingly in a backward direction.

5. The door handle device according to claim 4, wherein said fixed seat is provided at the end portion thereof opposite the latch receiver unit with a through hole (18) containing an internal push rod (17), and said push rod contacts an operating lever (29) for moving said latch member (9) slidingly in a backward direction to unlock the door.

6. A door handle device unlockable from an indoor side of a door, the device comprising:

a handle unit (2) fastened to a door, and a latch receiver unit (4) fastened to a wall of a refrigerator compartment (3), said handle unit (2) consisting of a fixed seat (5) attached to said door and provided with a pair of bearing members (15, 16) at the front portion a movable body (7) connected to said fixed seat by a pivot (6) attached to said bearing members, said movable body (7) being provided with a slidable latch member (9) adapted to engage with and disengage from a latch-receiving member (8) of said latch receiver unit (4);

an operating handle (10) adapted to drive said latch member (9) slidingly in a backward direction against a spring;

a setting bolt (12) being inserted into a through bore (19) provided in said door and engaged with a threaded blind bore (13) provided in a rear portion of said movable body (7) so as to secure said movable body to said door, said setting bolt having an operating portion (12*a*) positioned inside said refrigerator compartment and adapted to be turned relative to the movable body to remove the setting bolt from the threaded bore and disengage the latch member from the latch receiving member to permit opening the door.

* * * * *